US005146636A

United States Patent [19]

De La Pena

[11] Patent Number: 5,146,636

[45] Date of Patent: Sep. 15, 1992

[54] HEAT AND SMOKE PROTECTIVE HOOD

[76] Inventor: John M. D. De La Pena, Old Farm House Hanwell, Nr. Banbury, Oxon OX17 1HN, Great Britain

[21] Appl. No.: 687,922

[22] PCT Filed: Oct. 5, 1990

[86] PCT No.: PCT/GB90/01534

§ 371 Date: Aug. 2, 1991

§ 102(e) Date: Aug. 2, 1991

[87] PCT Pub. No.: WO91/04765

PCT Pub. Date: Apr. 18, 1991

[30] Foreign Application Priority Data

Oct. 5, 1989 [GB] United Kingdom ..... 8922427

[51] Int. Cl.[5] ..... A42B 3/00

[52] U.S. Cl. ..... 2/202; 2/8; 2/205

[58] Field of Search ..... 2/7, 8, 9, 171, 172, 2/173, 174, 202, 205, 206, 410, 424

[56] References Cited

U.S. PATENT DOCUMENTS

| | | | |
|---|---|---|---|
| 2,017,328 | 10/1935 | Taylor | 2/174 |
| 3,521,629 | 7/1970 | Reynolds | 2/8 |
| 3,789,839 | 2/1974 | Lund | 2/206 |
| 4,573,217 | 3/1986 | Reed . | |
| 4,589,408 | 5/1986 | Singer | 2/205 |
| 4,870,959 | 10/1989 | Reisman | 2/7 |
| 4,887,316 | 12/1989 | Morandini | 2/202 |
| 5,025,507 | 6/1991 | Kirby | 2/171 |

FOREIGN PATENT DOCUMENTS

| | | | |
|---|---|---|---|
| WO88/06907 | 9/1988 | PCT Int'l Appl. . | |
| 614379 | 11/1979 | Switzerland | 2/8 |
| 2129670 | 5/1984 | United Kingdom . | |
| 2202151 | 9/1988 | United Kingdom . | |
| 2226490 | 7/1990 | United Kingdom . | |
| 8202665 | 8/1982 | World Int. Prop. O. | 2/202 |
| 9005565 | 5/1990 | World Int. Prop. O. | 2/205 |

*Primary Examiner*—Werner H. Schroeder
*Assistant Examiner*—Diana L. Biefeld
*Attorney, Agent, or Firm*—Young & Thompson

[57] ABSTRACT

A heat and smoke protective hood comprises a bag-like head covering 1 of a heat-resistant, substantially gas-impermeable sheet material adapted to fit loosely over the head of a user, filter means 5 in an aperture 6 of the head covering to remove harmful ingredients from inhaled air, a stretchable annular neck portion 2 attached around the open end 3 of the head covering to form a seal around the user's neck, and a flexible annular skirt 8 of heat and flame resistant material attached around the circumference of the head covering so as to hang down around the neck portion and user's neck to protect both. Preferably, the skirt 8 also covers the filter means 5.

4 Claims, 1 Drawing Sheet

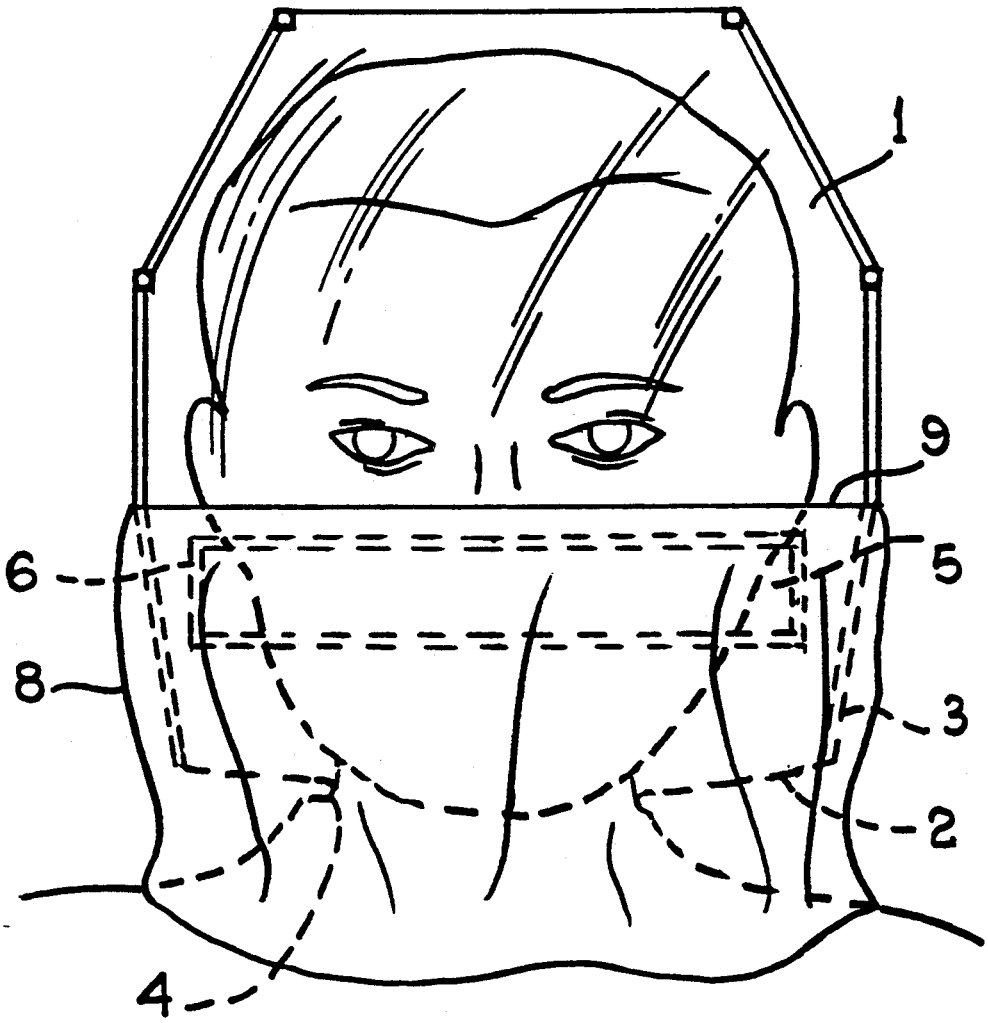
1
9
6
5
8
3
2
4

HEAT AND SMOKE PROTECTIVE HOOD

TECHNICAL FIELD

This invention relates to a heat and smoke protective hood which is suitable for use in fire emergencies.

A heat and smoke protective hood is known which consists of a bag-like head covering of a heat-resistant, substantially gas-impermeable sheet material adapted to fit loosely over the head of the wearer, filter means provided across an aperture of the head covering to filter harmful ingredients from air inhaled by the wearer through said aperture and filter means, and a neck portion of stretchable material attached to the open end of the head covering and having a hole through which the head of the wearer may be inserted by stretching the neck portion, said stretchable material being such as to revert to a less stretched condition in which it embraces the neck of the wearer.

The effectiveness of such a hood is dependent on the specification of the materials, in particular, their heat and flame retardant properties. Typically, the head covering has been composed of a polyimide film sold by Du Pont de Nemours International S.A. under the registered trade mark "KAPTON", and the neck portion has been composed of a flame retardant polyurethane. However, there is some difficulty in selecting an ideal material for the neck portion which is heat and flame retardant and also sufficiently elastic to stretch over a user's head and still relax to form a good neck seal, especially allowing for a wide range of head sizes of adults and children.

DISCLOSURE OF THE INVENTION

An object of the present invention is to provide a head and smoke protective hood in which the above difficulty is reduced or overcome.

This is achieved by providing the aforesaid known hood with an annular skirt of a flexible, heat and flame resistant material attached to the hood covering around its circumference so as to hang down over the outside of the neck portion and protect it and the neck of the wearer from heat and flames. The skirt therefore serves the function of heat and flame protection, and the neck portion can be composed of a material which is primarily selected to be sufficiently elastic to stretch over any size head and form a good seal around the neck.

Preferably, the skirt also hangs down over the filter means, the skirt being air-permeable so as to allow the passage of inhaled air, and also serving to protect the filter against heat and flames. However, the skirt is preferably attached below the level of the user's eyes so that it does not obstruct the view of the user through the head covering, which is either transparent or has a window in it.

DESCRIPTION OF THE DRAWINGS

The accompanying drawing shows a heat and smoke protective hood according to the invention as worn by a user.

BEST MODE FOR CARRYING OUT THE INVENTION

The illustrated heat and smoke protective hood comprises a head covering 1 in the form of an open ended bag composed of transparent polyimide sheet material which is heat and flame resistant. An example of such material is that sold by Du Pont de Nemours International under their registered trade mark "KAPTON". An annular neck portion 2 is connected around the lower edge 3 of the open end of the bag-like head covering 1 and is composed of an elastic sheet material such as latex or neoprene latex sheet so that it will readily stretch as the head of a user is inserted through the central aperture 4 and then relaxes to form a seal around the user's neck. A filter pad 5 is sealed across an opening 6 in the side wall of the head covering 1, and is composed of suitable material such as activated charcoal cloth to absorb harmful materials in the air as it is drawn through it by the user inhaling. Preferably, two such pads 5 are provided in the front and rear walls of the head covering so as to extend around substantially the whole circumference of the head covering.

The particular improvement of the illustrated hood according to the present invention consists in providing the annular skirt 8 of a flexible heat and flame resistant material around the outside of the head covering 1, being attached to the head covering along its top edge 9 and hanging down around the neck portion 2 and the neck of the user so as to protect both from heat and flames. As illustrated, the skirt 8 is preferably attached to the hood covering below the level of the user's eyes but above the filter pad 5 so that the latter is also protected The skirt 8 may be composed, for example, of the material sold by Du Pont de Nemours under their registered trade mark "NOMEX", or that sold by Universal Carbon Fibres Limited under their trade mark "PANOTEX". This material may be woven or knitted and in the latter form may be stretchable.

I claim:

1. A heat and smoke protective hood comprising a bag-like head covering of a heat-resistant substantially gas-impermeable sheet material adapted to fit loosely over the head of the wearer; filter means provided in an aperture of the hood covering to filter harmful ingredients from air inhaled by the wearer through said aperture and a neck portion of stretchable material attached to the open end of the head covering and having a hole through which the head of the wearer may be inserted by stretching the neck portion, said stretchable material being such as to revert to a less stretched condition in which it embraces the neck of the wearer; and an annular skirt of a flexible, heat-resistant material attached to the head covering around its circumference so as to hang down over the outside of the neck portion and the filter means to protect the neck portion, the filter means and the neck of the wearer from heat and flames.

2. A hood as claimed in claim 1, in which the annular skirt is air-permeable to allow the passage of air inhaled by the wearer.

3. A hood as claimed in claim 1, in which the annular skirt is composed of a stretchable material.

4. A hood as claimed in claim 1, in which the head covering has transparent areas which in use are located in front of the eyes of the wearer, and in which the annular skirt is attached to the head covering below the transparent areas so that it does not obstruct the view of the wearer.

* * * * *